United States Patent [19]

Thompson

[11] 4,159,888

[45] Jul. 3, 1979

[54] THRUST BALANCING

[75] Inventor: Douglas K. Thompson, Indianapolis, Ind.

[73] Assignee: General Motors Corporation, Detroit, Mich.

[21] Appl. No.: 840,267

[22] Filed: Oct. 7, 1977

[51] Int. Cl.[2] ..... F01D 3/00; F01D 3/04

[52] U.S. Cl. ..... 415/105; 415/107; 308/160

[58] Field of Search ..... 415/104, 105, 106, 107; 308/160, 187, 219

[56] References Cited

U.S. PATENT DOCUMENTS

| | | | |
|---|---|---|---|
| 1,721,614 | 7/1929 | Carrier | 415/105 |
| 2,319,913 | 5/1943 | Bentley | 415/105 |
| 3,468,259 | 9/1969 | Morzynski et al. | 415/175 |
| 3,485,541 | 12/1969 | Sandy | 308/160 |
| 3,491,536 | 1/1970 | Hadaway | 60/39.31 |
| 3,505,813 | 4/1970 | McCarthy | 60/39.31 |

*Primary Examiner*—Louis J. Casaregola
*Attorney, Agent, or Firm*—J. C. Evans

[57] ABSTRACT

A gas turbine engine having variable geometry flow controllers therein for controlling mass flow in accordance with engine operation includes a rotor with a wide variation in thrust forces thereon during different phases of engine operation countered by a variable axial load integrating device having a rotating hydraulic thrust compensating piston mounted forwardly of the rotor in association with a rotor thrust bearing and further including means for generating a centrifugal head in accordance with engine speed by means of rotating oil trapped between the rotating piston and a nonrotating counter piston; depth of rotating oil is automatically regulated by an integral, flow regulator having flow area therethrough varied in accordance with axial position of a thrust bearing carriage that has the variable rotor thrust loading imposed thereon.

4 Claims, 3 Drawing Figures

THRUST BALANCING

The invention herein described was made in the course of work under a contract or subcontract thereunder with the Department of Defense.

This invention relates to gas turbine engines and more particularly to means for compensating for variable thrust produced upon a rotor of a gas turbine engine.

Various proposals have been suggested for producing a hydraulic pressure differential upon bearing components so as to adjust axial thrust acting thereacross. For example, in U.S. Pat. No. 3,485,541, issued Dec. 23, 1969, to Sandy Jr., a balancer disc on a drive shaft has hydraulic pressure differentials produced thereacross so as to control the axial position of an associated shaft.

Another approach to balancing thrust in a rotary machine is set forth in U.S. Pat. No. 3,505,813 issued Apr. 14, 1970, to McCarthy, wherein compressed gases are directed against a component to maintain a shaft in a substantially constant axial position relative to fixed structure of the engine, thereby to maintain a resultant axial load on a rotor thrust bearing substantially constant.

U.S. Pat. No. 3,468,259 issued Sept. 23, 1969, to Morzynski et al, includes an axial relieving arrangement for impeller type pumps wherein a spring bias thrust bearing is balanced by means of fluid in pressure balanced cavities having oil pressure directed therethrough and controlled to maintain a balanced load condition on the thrust bearing of the assembly.

U.S. Pat. No. 3,491,536, issued Jan. 27, 1970, to Hadaway, shows a gas turbine shaft bearing assembly having plurality of spring washers located therein producing opposed preloading spring forces for maintaining components of thrust bearings in a rotor assembly support constantly under load contact so as to avoid excessive vibration therebetween.

While the aforedescribed shaft positioning and/or thrust bearing load balance systems are suitable for their intended purpose they will not meet the requirements found in advanced variable geometry gas turbine engines of the type set forth in U.S. Pat. No. 3,528,250 issued Sept. 15, 1970, to D. Johnson wherein large swings in rotor thrust forces can occur during different phases of the operating modes of the engine. In such engines it is desirable to maintain a maximized thrust-to-weight ratio over the total operating range. It is necessary therefore to use the lightest weight construction possible including static supports for bearing assemblies and bearing assemblies themselves as well as the weight construction of associated thrust load compensating devices.

Accordingly, an object of the present invention is to improve variable rotor thrust loading devices for use in variable geometry gas turbines having large swings and rotor thrust forces thereon, by the provision therein of a device mounted closely adjacent a rotor thrust bearing and wherein a thrust compensation force is generated by means of a centrifugal head by engine oil trapped between a rotating piston mounted on the rotor shaft and a nonrotating counter piston mounted from the bearing support structure and wherein the amount of hydraulic thrust compensation force is automatically regulated without the requirement for external control systems.

Still another object of the present invention is to provide an improved rotor thrust balance device including a variable axial load integrating device with a pair of relatively rotating piston components mounted on a rotor shaft and to a bearing support structure respectively and including an oil pressure supply for producing a depth of centrifuged oil in an oil cavity between the relatively rotating pistons under control of a flow regulator having an area therethrough varied in accordance with bearing carriage position to produce a centrifugal head by the oil trapped between the relatively rotating pistons and a resultant thrust compensation rotor force.

Still another object of the present invention is to improve a gas turbine engine thrust bearing having rotor thrust forces directed thereagainst that vary from a thrust in a rearward direction during a first engine operating mode and in a forward direction under a second operating mode by provision of a variable axial load integrating device including a pair of relatively rotating pistons connected respectively to the engine drive shaft and to a fixed bearing support component and include means for directing oil therebetween and means on the rotating piston to cause oil trapped between a rotating one of the pair of pistons and a nonrotating counter piston thereof to rotate with the rotor to develop a dynamic head that will counter the wide swings in rotor thrust levels so as to keep bearing load unidirectional and within a reduced range under all anticipated operating conditions.

Further objects and advantages of the present invention will be apparent from the following description, reference being had to the accompanying drawings wherein a preferred embodiment of the present invention is clearly shown.

Figure 1:
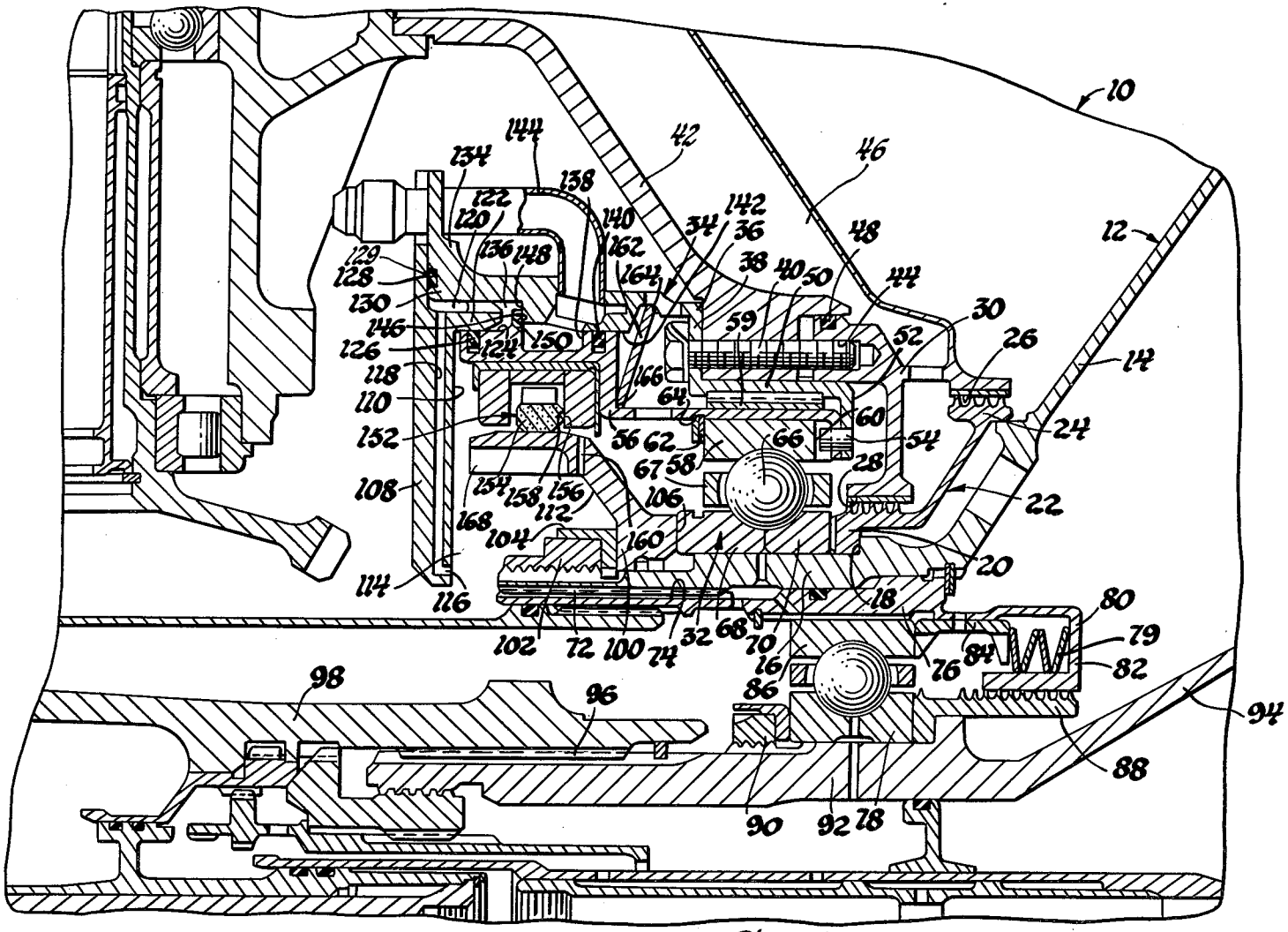
FIG. 1 is a fragmentary longitudinal sectional view of a gas turbine engine thrust balancer of the present invention.

Referring now more specifically to FIG. 1 of the drawings, a fragmentary section is shown of a gas turbine engine of the variable geometry engine type with bypass fan that includes large swings in rotor thrust forces. More particularly, the engine 10 includes a high pressure compressor rotor 12, a portion of which is shown in FIG. 1. It includes a generally upwardly directed shaft segment 14 that is connected to an axially directed segment 16. The segment 16 includes an annular outer peripheral shoulder 18 thereon that supports one end 20 of an annular labyrinth seal assembly 22 having an opposite end 24 thereon. The ends 20, 24 of the labyrinth seal assembly 22 are located in rotating sealing relationship with a first annular seal surface 26 and a second annular seal surface 28 axially spaced and radially inwardly located from surface 26 and formed on a fixed seal support member 30 within the engine 10. A thrust bearing assembly 32 is located between the rotor segment 16 and the suppport structure 42 and is associated with a variable axial load integrating device 34 constructed in accordance with certain principles of the present invention.

It has been found that in advanced variable geometry engines that large swings in rotor thrust balance forces can occur on the rotor 12. For example, in one type of variable geometry gas turbine engine rotor thrust acting on the rotor 12 can vary in a rearward direction from a substantially zero thrust to a maximum calculated load in the order of 10,000 pounds. The variable axial load integrating device 34 is of light weight and readily associated with existing thrust bearing assemblies 32 to reduce bearing load at high rotor thrust loads.

More particularly, the device 34 includes an outer housing 36 with a flange 38 thereon connected by means of threaded bolts 40 one of which is illustrated in FIG. 1. The bolt 40 secures flange 38 and the seal support 30 to the support structure 42. The end of each bolt 40 is received within a tapped bore 44 in the seal support 30. An annular O-ring seal 48 is contained within an annular groove in the seal support 30 to prevent the leakage of bearing lubricating oil into the air passage 46.

The flange 38 includes a tubular extension 50 with a small inward projecting tang 52 into which is secured a pin 54 which prevents circumferential rotation of the bearing outer race 58 and the bearing carriage 56. The outer race 58 is biased radially by leaf springs 59 trapped on assembly between the bearing carriage 56 on the inside and the tubular extension 50 of the outer housing 36 on the outside. The bearing outer race 58 has a radial slot 60 which engages the pin 54 to prevent race rotation. Further, the outer race 58 is axially contained within the bearing carriage 56 by means of a snap ring 62 seated in an inner peripheral groove 64 of the carriage 56. The thrust bearing assembly 32 includes a plurality of ball elements 66 located at circumferentially spaced points as established by a ball retainer 67. Additionally, the thrust bearing assembly 32 includes a pair of inner races 68, 70. The inner race 70 engages the end 20 of the labyrinth seal assembly 22 and is carried by the high pressure compressor rotor 12 to transfer operational thrust loads from the rotor 12 into the thrust bearing assembly 32. Rotor 12, thrust bearing 32 and carriage 56 move as a unit a limited axial extent in the order of 0.010 inches.

In the illustrated arrangement of FIG. 1, the segment 16 of the rotor 12 has internal splines 72 connected to external splines 74 on an intershaft connector 76 that supportingly receives an intershaft bearing assembly 78 having the outer race thereof axially loaded by means of a plurality of Belleville springs 79 that are stacked in a spring carriage 80 to direct a predetermined thrust against an outboard wall portion 82 thereof and a reaction thrust against an axially movable spacer element 84 that engages the outer race 86 of the intershaft bearing assembly 78 so as to maintain component parts thereof tensioned. A labyrinth seal unit 88 seals the spring carriage 80 to prevent oil leakage at the interstage bearing assembly 78. It in turn, is held in place by means of a fastener nut 90 threadably received on an axial segment 92 of an internally located low pressure compressor shaft 94. The low pressure compressor shaft 94 is connected at a splined coupling 96 to a segment of an internally located fan shaft 98 that is directed in a forward direction to be coupled to a fan component of the fan bypass type variable capacity gas turbine engine 10. The aforedescribed internal shaft and intershaft bearing components are merely representative of shaft components that are associated with rotors such as rotor 12 having substantial swings in thrust loading thereon as produced in variable geometry engines of the type under consideration.

The variable axial load integrating device 34 is operative to compensate loads from the rotor 12 into the thrust bearing assembly 32. Sections of parts illustrated in FIG. 1 are for annular components which extend circumferentially around the outer periphery of rotor segment 16.

The device 34, in accordance with certain principles of the present invention, includes an internally located, rotating piston 100 secured by means of a threaded retainer nut 102 and lock washer 104 on one end of the shaft segment 16 of rotor 12 to be rotated therewith. The piston 100 includes an axially inboard surface 106 thereon that is held against the inner race 68 to produce a transfer of hydraulic forces through the inner race component 68 to balance the variable gas load produced on the inner race 70. The rotary piston 100 is associated with a nonrotating counter piston 108 that includes a smooth annular radial surface 110 thereon located in facing relationship to an inner peripheral surface 112 on piston 100 which is ribbed 168 to trap oil on surface 112 for rotation with piston 100. A cavity 114 is formed therebetween and constitutes a space for receiving a hydraulic fluid such as engine oil from an outlet 116 of a passage 118 in the nonrotating counter piston 108. The passage 118 is in communication with an annular cavity 120 formed by an axial extension 122 on the nonrotating counter piston 108 that fits on an axial annular end 124 of the carriage 56. It includes an annular O-ring seal 126 sealed against the extension 122. A second annular O-ring seal 128 is supportingly received into a groove 200 in the outer housing 36. The seals 126, 128 close a pressurizable control cavity 136 that communicates the passage 118 with an inlet groove 138 formed in the outer periphery of the end 124 of the carriage 56. The inlet groove 138 is sealed at its inboard end by an annular O-ring seal 140 that is slidably located for reciprocating motion with respect to a seal bore 142 inside the outer housing 36. The inlet groove 138 is supplied by a tube 144 that is adapted to be connected to a supply of hydraulic fluid such as engine oil delivered at main engine oil pressure. The oil pressure itself is not critical to operation of the device 34 as long as there is sufficient supply of oil to deliver flow requirements to maintain an oil depth in the cavity 114 during different phases of operation to be discussed. The depth of oil in the cavity 114 more particularly is maintained by regulating the inflow of oil from tube 116 without the need for flow regulator components external of device 134.

More particularly, flow regulation in the device 34 is accomplished between opposed surfaces 146, 148 on the movable carriage 56 and fixed bearing support outer housing 36. Relative axial movement between surfaces 146, 148 will produce an annular throttling gap to communicate the inlet groove 138 and the control cavity 136 when oil flow is required to be delivered into the cavity 114.

Additionally, a bypass orifice 150 is formed in the piston 124 to directly communicate the groove 138 with the control cavity 136 when the surfaces 146, 148 are closed against one another to provide a minimum flow of oil to lubricate the seal 154.

In the illustrated arrangement, a seal assembly 152 contains the oil in the cavity 114. In the illustrated arrangement, the seal assembly 152 constitutes a carbon seal element 154 having a radial face 156 thereon rotated in sealing relationship with respect to a nonrotating surface 158. Controlled leakage from the cavity 114 occurs through a bleed opening 160 in the rotary piston 100 to allow controlled leakage of oil from the cavity 114 as required to dissipate the heat generated in the oil cavity during thrust compensation operation.

The operation of the assembly illustrated in FIG. 1 includes an initial phase of operation as produced during engine start-up. In one predetermined variable thrust gas turbine engine, during engine start-up, the rotor 12 imposes a zero rotor thrust against the inner races 68, 70. A 400 pound Belleville spring 162 has one edge thereof seated against a shoulder 164 inside the outer housing 36 and the opposite edge thereof seated on a shoulder 166 on the carriage 56. The force of the Belleville spring will position the regulator surfaces 146, 148 apart to permit a flow through a passage 118 in the nonrotating piston 108 into the cavity 114. Oil in the cavity 114 is rotated by the piston 100 to generate a centrifugal hydraulic force acting against the surface 112 of the piston 100 to the right as viewed in FIG. 1. The cavity 114 will continue to fill until the hydraulic force acting on surface 112 overcomes the 400 pound Belleville spring force and the flow regulating surfaces 146 and 148 close cutting off the flow of oil into cavity 114. This cycle will repeat until the system comes into balance with a 400 pound load on the thrust bearing and all other rotor thrust carried through the hydraulic pistons 100, 108.

During a forward thrust mode of operation the rotor 12 is operative to direct a substantial load in the order of 4000 pounds in a direction toward the left as viewed in FIG. 1. The Belleville spring 162 acting on the bearing carriage 56 causes the carriage to move to the left opening the regulating surfaces 146 and 148 causing oil to flow into the cavity 114. The depth of the engine oil is increased to a level, and the speed of rotation of the rotor 12 under forward rotor thrust conditions is such that a hydraulic load in the order of 4400 pounds is directed onto the rotating piston 100 to counterbalance the rotor thrust and to maintain a minimal 400 pound bearing load on the bearing assembly 32 between inner race element 68 and the outer race 58.

In accordance with certain principles of the present invention the illustrated variable axial load integrating device 34 has additional flexibility in that it will compensate for a rearward rotor thrust as produced during still another mode of engine operation. In this case a rotor thrust from the rotor 12 is generated in a direction to the right as viewed in FIG. 1 in the order of 900 pounds. Under this operating mode, the intermediate range of rotor thrust pulls the bearing assembly 32 along with the carriage 56 against the 400 pound preload of the Belleville spring 162 and thereby causes the surfaces 146, 148 of the regulator to close against one another. Accordingly, the flow regulator of the device 34 is closed and only bypass oil will flow into the cavity 114. The bypass flow is minimal as required to lubricate the seal. Accordingly, there is no trapped oil on ribs 168 on surface 112 of the rotating piston 100 and hydraulic force acting to the right will be reduced to substantially zero. In any case, bearing load reversals are eliminated and bearing loads are maintained within a 400 pound to 900 pound range under all anticipated operating conditions.

Figure 2:
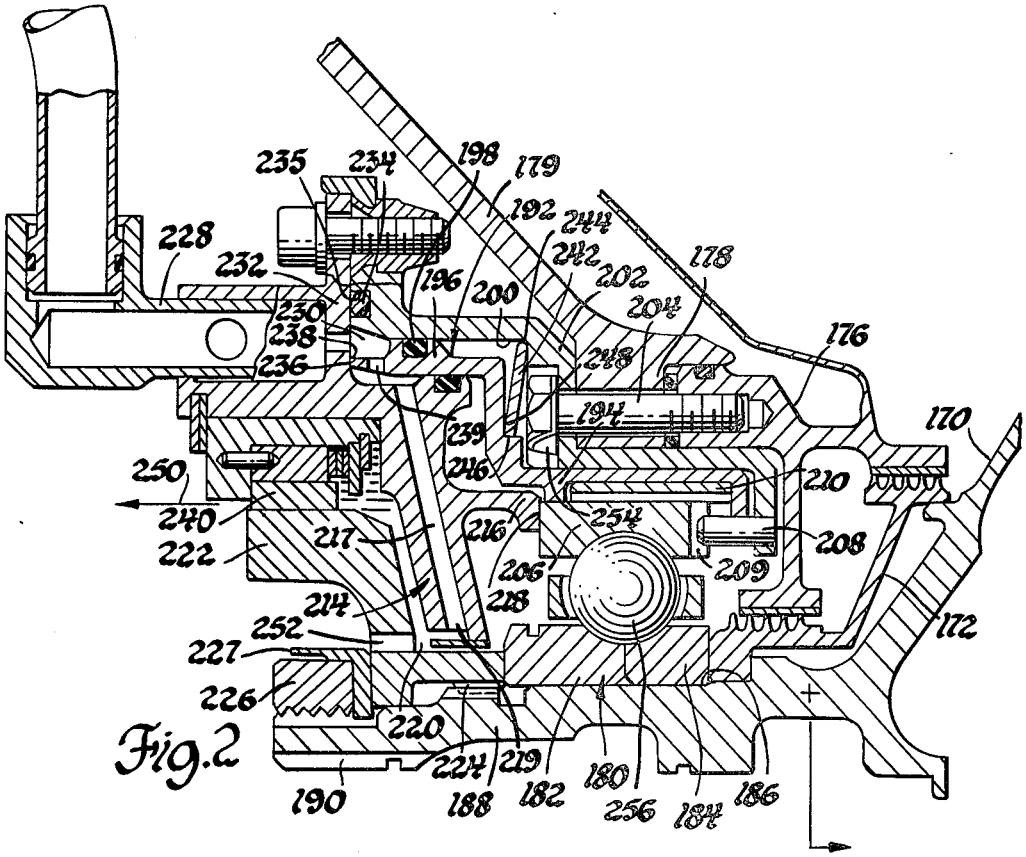
FIG. 2 is a fragmentary sectional view of another embodiment of the thrust balancer.
Figure 3:
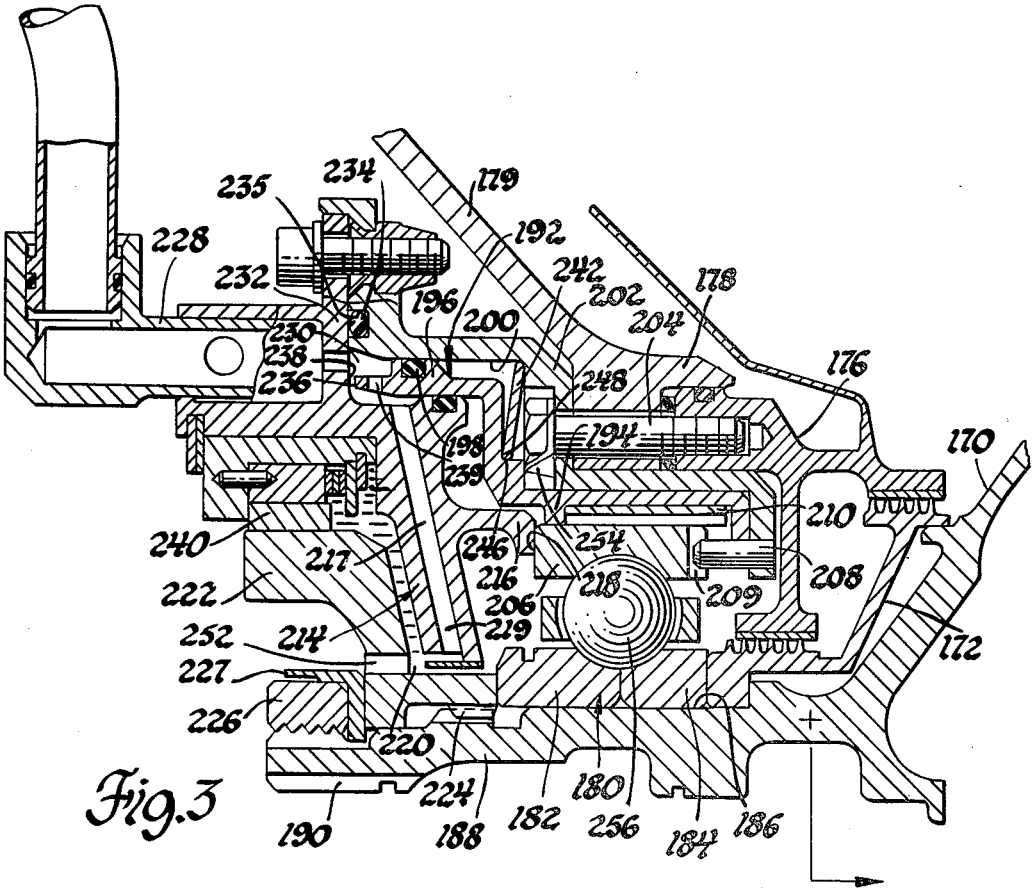
FIG. 3 is the device in FIG. 2 in a second operating position.

FIGS. 2 and 3 illustrate a second embodiment of the invention which is modified to compensate another advanced variable geometry engine having variable thrust therein. The embodiment of FIG. 2 includes a rotor 170 that includes a zero rotor thrust under start up conditions, a 1000 pound rotor thrust acting to the right under an intermediate thrust load greater than 400 pounds (FIG. 2) and at a thrust in the order of 10,000 pounds also to the right (FIG. 3) under a full thrust load. The rotor 170 is associated with a labyrinth seal assembly 172 like that shown in the first embodiment which is similarly affixed to the support structure 179. An axial thrust bearing assembly 180 is supportingly received in a manner similar to the first embodiment by the bearing carriage 194, leaf springs 210, and support housing 202. The bearing includes inner race components 182, 184 slidably supported on the outer diameter 186 of the stub shaft 188 at the front of the rotor 172.

In FIGS. 2 and 3, a variable axial load integrating device 192 is associated with the thrust bearing 180 to maintain the integrity of internal shaft and bearing component of the type described in the first embodiment. In this arrangement, the variable axial load integrating device 192 includes a carriage 194 having an outboard segment 196 thereon carrying a peripheral O-ring seal 198 that slidably sealingly engages a bore 200 in an outer housing 202. As in the previous case, a stud 204 secures the housing portion 202 and the seal support 176 to the fixed support 179. The outer race 206 of the bearing assembly 180 and the carriage 194 are fixedly secured against rotation by means of a pin 208 in a tang 209 which extends inward from the support housing 202.

Leaf springs 210 resiliently support the outer race 206 with respect to the carriage 194. As in the case of the first embodiment the rotor 170, the thrust bearing 180 and the carriage 194 move as a unit through a limited axial distance in the order of 0.010 inches. A snubber 216 extending to the right from the counter piston 214 prevents excessive travel of the bearing outer race by engaging surface 218 of bearing race 206. The counterpiston 214 includes an oil supply passage 217 with an outlet 219 into a cavity 220 formed between the nonrotating piston 214 and a rotating piston 222 secured against rotation on the rotor stud shaft 188 by means of a splined coupling 224. The rotating piston 222 is held in place on the stub shaft 188 by means of a retainer nut 226 and a lock washer 227.

As in the case of the first embodiment, oil at engine oil pressure is supplied by an inlet tube 228 into an inlet cavity 230 formed between an outer peripheral flange 232 on the nonrotating counterpiston 214. Cavity 230 is sealed with respect to the outer housing 202 by an annular O-ring 234 supported in an outboard peripheral groove 235 in the housing 202. Oil flow from the inlet cavity 230 is across a throttling gap between opposed surfaces 236, 238 formed respectively on the flange 232 and the tip of the axially movable bearing carriage 194. The bearing carriage 194 further includes a bypass opening 239 that will supply a limited amount of oil to lubricate the seal 240 during operation with the flow regulating surfaces 236, 238 closed. Oil from the inlet cavity 230 is directed to the passage 217 into the cavity 220 between the rotating piston 222 and the nonrotating counter piston 214. As in the case of the first embodiment, the cavity 220 is sealed by a bushing type seal assembly 240.

In the aforesaid system, during engine start-up, the bearing carriage 194 is pushed toward the left as shown in FIG. 2 by a Belleville spring 242 that includes a radially outer edge 244 seated against the housing 202 and a radially inner edge 246 biased against an external shoulder 248 on the carriage 194. The Belleville spring 242 has a preload of approximately 400 pounds to cause the facing surfaces 236, 238 of the flow regulator to be closed. Oil flow from the inlet tube 228 is thereby limited to flow across the bypass opening 139 so that during start-up or conditions where less than 400 pounds thrust load occurs on the rotor 170, oil flows into the cavity 220 only in sufficient quantity to lubricate the bushing type seal assembly 240.

During engine operation to produce an intermediate rotor thrust load greater than 400 pounds in a direction to the right on the rotor as viewed in FIG. 2, the force of the Belleville spring 242 which acts to the left as shown in FIG. 2, will be overcome. Accordingly, the bearing carriage 194 will move to the right as shown in FIG. 2 and thereby open the annular opening between opposed surfaces 236, 238. Oil will flow inwardly through the regulator, thence through the passage 217 and the outlet 219 into cavity 220 at the extension 188 of the rotor 170. As the oil level fills up in the cavity 220 and the piston 222 continues to rotate, a centrifugal oil force will be developed against the rotating piston and will act to the left as viewed in FIG. 2 to compensate the thrust loading on the rotor 170. The cavity 220 continues to fill until the forward centrifugal force equals the rotor thrust force minus 400 pounds represented by the pre-bias of the Belleville spring 242. Consequently, the opposed surfaces 236, 238 come into balance and will thereafter cycle open and closed to maintain a constant depth of oil in the piston cavity 220. If the rotor thrust increases to the right, the regulator moves toward its open position. If the centrifugal oil force increases as produced on the rotary piston 222, the regulator moves toward its closed position. The rotor thrust bearing 180 accordingly only has a rearward thrust load of 400 pounds thereon during this phase of operation, equal to the Belleville spring load. In the illustrated arrangement in FIG. 3 a third operating mode with maximum rearward rotor thrusting on the rotor 170 is shown. In this mode of operation, rotor thrust may be in the order of 10,000 pounds acting to the right as shown in FIG. 3. During this mode the rotor thrust will exceed the capacity of the variable axial load integrating device 192 and the rotor 170 will move to the right the full 0.010 inches of travel thereby to fully open the regulator at a maximum space between the facing surfaces 236, 238. Consequently, the cavity 220 will be filled to overflowing and the overflow of engine oil will be directed through spill holes 252 in the rotating piston 222. Consequently, oil will not flow in a rearward direction over the hub of the nonrotating counterpiston and as a result there will be no flooding of the cavity for bearing 180. The Belleville spring 242 and the hydraulic force on the rotating piston 222 will be unable to resist the rearward force on the rotor 170 and as a result the bearing carriage will move to a full rearward position as shown in FIG. 3 to engage a carriage snubber 254. The bearing itself will, therefore, assume a force in the right direction as shown in FIG. 3 which is equal to the rotor thrust less the centrifugal oil force of the device 194. In order to produce full compensation, the diameter of the cavity 220 can be increased in some applications but, in any event, the aforesaid arrangement minimizes the loads acting on the ball elements 256 of the bearing assembly 180.

While the embodiments of the present invention, as herein disclosed, constitute a preferred form, it is to be understood that other forms might be adopted.

The embodiments of the invention in which an exclusive property or privilege is claimed are defined as follows:

1. A rotor thrust compensator assembly for association with a gas turbine engine comprising: a rotor extension having a fore and aft segment and being axially movable in response to variable gas loads on a rotor element of a gas turbine engine, a thrust bearing having inner and outer races with anti-friction means therebetween, one of said races fixed to said rotor extension for axial movement therewith, bearing support means for the other of said races, variable axial load integrating means including a pair of relatively rotating pistons with a cavity therebetween, a pressurizable fluid system, flow regulator means including a movable carriage engageable with the other of said races and including means thereon for directing fluid into said fluid system and for directing a quantity of fluid into said cavity in accordance with rotor thrust loads acting on the one of said races, the movement of said movable carriage controlling a throttling gap for said fluid, a preload spring biased between said carriage and said bearing support and operative to compensate axial bearing loads when a first predetermined rotor thrust load is imposed on said bearing, one of said relatively rotating pistons being connected to said rotor extension, said one of said relatively rotating pistons rotating fluid within said cavity so as to produce a dynamic, rotor speed responsive centrifugal fluid head on said rotor extension to compensate second predetermined rotor thrust loadings on said bearing.

2. A rotor thrust compensator assembly for association with a gas turbine engine comprising: a rotor extension having a fore and aft segment and being axially movable in response to variable gas loads on a rotor element of a gas turbine engine, a thrust bearing having inner and outer races with anti-friction means therebetween, one of said races fixed to said rotor extension for axial movement therewith, bearing support means for the other of said races, variable axial load integrating means including a pair of relatively rotating pistons with a liquid cavity therebetween, a pressurizable oil system for receiving engine oil, flow regulator means including a movable carriage engageable with the other of said races and including means thereon for directing engine oil into said oil system and for directing a quantity of oil into said liquid cavity in accordance with rotor thrust loads acting on the one of said races, the movement of said movable carriage controlling a throttling gap for said oil, a preload spring biased between said carriage and said bearing support and operative to compensate axial bearing loads when a first predetermined rotor thrust load is imposed on said bearing, one of said relatively rotating pistons being connected to said rotor extension, said one of said relatively rotating pistons rotating oil within said cavity so as to produce a dynamic, rotor speed responsive centrifugal fluid head on said rotor extension to compensate second predetermined rotor thrust loadings on said bearing.

3. A rotor thrust compensator assembly for association with a gas turbine engine comprising: a rotor extension having a fore and aft segment and being axially movable in response to variable gas loads on a rotor element of a gas turbine engine, a thrust bearing having inner and outer races with anti-friction means therebetween, one of said races fixed to said rotor extension for axial movement therewith, bearing support means for the other of said races, variable axial load integrating means including a pair of relatively rotating pistons with a liquid cavity therebetween, a pressurizable oil system for receiving engine oil, flow regulator means including a movable carriage engageable with the other of said races and including means thereon for directing engine oil into said oil system and for directing a quantity of oil into said liquid cavity in accordance with rotor thrust loads acting on the one of said races, the movement of said movable carriage controlling a throttling gap for said oil, a preload spring biased between said carriage and said bearing support and operative to compensate axial bearing loads when a first predetermined rotor thrust load is imposed on said bearing, means including said spring causing said carriage to be positioned to open said flow regulator means thereby to cause pressurization of said oil system when the first predetermined rotor thrust load is imposed on said bearing, one of said relatively rotating pistons being connected to said rotor extension, said one of said relatively rotating pistons rotating oil received within said cavity to produce a dynamic, rotor speed responsive centrifugal fluid head on said rotor extension to compensate second predetermined rotor thrust loadings on said bearing.

4. A rotor thrust compensator assembly for association with a gas turbine engine comprising: a rotor extension having a fore and aft segment and being axially movable in response to variable gas loads on a rotor element of a gas turbine engine, a thrust bearing having inner and outer races with anti-friction means therebetween, one of said races fixed to said rotor extension for axial movement therewith, fixed bearing support means for the other of said races, variable axial load integrating means including first and second relatively rotating pistons with a means on said first and second pistons forming a liquid cavity therebetween, said first piston being connected to said rotor extension, said second piston being fixed to said bearing support means, a pressurizable oil system for receiving engine oil, flow regulator means including a movable carriage engageable with the other of said races and including means thereon for directing engine oil into said oil system and for directing a quantity of oil into said liquid cavity in accordance with rotor thrust loads acting on the one of said races, the movement of said movable carriage controlling a throttling gap for said oil, a preload spring biased between said carriage and said bearing support and operative to compensate axial bearing loads when a first predetermined rotor thrust load is imposed on said bearing, means including said spring for causing said carriage to be positioned to open said flow regulator means thereby to cause pressurization of said oil system when the first predetermined rotor thrust load is imposed on said bearing, means on said first piston to pick up oil received within said cavity and to rotate it so as to produce a dynamic, rotor speed responsive centrifugal fluid head on said rotor extension to compensate second predetermined rotor thrust loadings on said bearing.

* * * * *